US006864450B1

(12) United States Patent
Chen et al.

(10) Patent No.: US 6,864,450 B1
(45) Date of Patent: Mar. 8, 2005

(54) CIRCUIT BREAKER WITH DELAY MECHANISM

(75) Inventors: Steven Zhenghong Chen, Coraopolis, PA (US); Daniel Evan Palmieri, Aliquippa, PA (US); Paul Thomas Bottegal, Lower Burrell, PA (US); Anthony Thomas Ricciuti, Pittsburgh, PA (US); Robert Nicklas Krevokuch, West Newton, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/848,801

(22) Filed: May 19, 2004

(51) Int. Cl.[7] ..... H01H 5/00
(52) U.S. Cl. ..... 200/400; 200/401; 335/174
(58) Field of Search ..... 200/400, 401; 335/174, 175

(56) References Cited

U.S. PATENT DOCUMENTS 3,835,275 A * 9/1974 Preuss ..... 200/400
4,181,829 A * 1/1980 Selas ..... 200/33 R
4,697,163 A * 9/1987 Grunert et al. ..... 335/174
4,933,519 A 6/1990 Milianowicz et al.
5,089,797 A * 2/1992 Grunert et al. ..... 335/172
5,304,765 A * 4/1994 Parks et al. ..... 200/401
5,875,088 A 2/1999 Matsko et al.
5,898,146 A * 4/1999 Beck et al. ..... 200/401
6,175,479 B1 1/2001 Boyd et al.
6,377,431 B1 4/2002 Jones et al.
6,738,243 B2 5/2004 Marchand et al.

* cited by examiner

*Primary Examiner*—K. Lee
(74) *Attorney, Agent, or Firm*—Martin J. Moran

(57) ABSTRACT

An improved circuit breaker includes an inertial time delay mechanism that permits a self-powered trip unit to become fully operational before inputting into the trip unit a signal indicating a change in the state of the circuit breaker. The time delay mechanism includes an inertia member, a first spring, and a second spring, and is activated upon the rotation of a lay shaft of an operating mechanism of the circuit breaker. The first spring extends between the inertia member and a housing of the circuit breaker and biases the inertia member from an initial position toward a terminal position. The second spring extends between the lay shaft and the inertia member and biases the inertia member toward the initial position when the circuit breaker is in an OFF condition. The combined action of the first and second springs on the inertia member provides a time delay using a relatively small inertial mass.

13 Claims, 4 Drawing Sheets

CIRCUIT BREAKER WITH DELAY MECHANISM

BACKGROUND OF THE INVENTION

1. Field of the Invention

The present invention relates generally to circuit breakers and, more particularly, to a circuit breaker having a delay mechanism that slightly delays the actuation of a switch upon moving the circuit breaker from an OFF condition to an ON condition.

2. Description of the Related Art

Circuit breakers and other power distribution equipment are generally known. A power distribution system often includes circuit breakers in a cascaded configuration that provides coordinated operation such that upon the occurrence of a fault condition or other condition requiring an interruption of power the circuit breaker in the closest upstream location trips. Such a system is provided in order to limit the power interruption in other areas that are unaffected by the fault or other condition.

Sometimes a given circuit breaker in a power distribution system is in an OFF condition while other circuit breakers in the power distribution system are in an ON condition. If a fault condition arises upon switching the OFF circuit breaker to an ON condition, such as when the circuit breaker closes onto a fault, it would be most desirable to trip the circuit breaker that was most recently switched to an ON condition. Circuit breakers in a power distribution system thus often are electronically connected together in order to enable in such a circumstance immediate tripping of the circuit breaker that was most recently switched to an ON condition. To enable such an electronic interconnection, the circuit breakers typically each include a trip unit that is configured to detect a change in condition of the circuit breaker, i.e., from an OFF condition to an ON condition.

Trip units of this type typically can be either externally powered, i.e., being powered by an auxiliary power system, or can be self-powered, i.e., by employing current transformers to draw current directly from the protected circuit. Self-powered trip units have had a particular shortcoming in that the electronics thereof do not become fully operational until a brief period of time after the circuit breaker has been switched to an ON condition. Specifically, upon switching the circuit breaker to an ON condition, current flows through the circuit breaker conductors, and the current transformers draw some of the current to begin powering the electronics. The electronics do not become operational until after the circuit breaker has been switched to an ON condition, and thus the self-powered trip unit cannot distinguish between a circumstance in which its associated circuit breaker had been in an ON condition but unpowered or if its associated circuit breaker was in an OFF condition and became powered by being switched to an ON condition.

It thus would be desirable to provide a circuit breaker having a self-powered trip unit that can distinguish between a first situation in which an unpowered circuit breaker in an ON condition became powered and a second situation in which a circuit breaker in an OFF condition became powered by switching it to an ON condition. Such a circuit breaker preferably would include an inertial delay mechanism that provides an appropriate time delay without requiring the use of a significant inertial mass.

SUMMARY OF THE INVENTION

An improved circuit breaker includes an inertial time delay mechanism that permits a self-powered trip unit to become fully operational before inputting into the trip unit a signal indicating a change in the state of the circuit breaker. The time delay mechanism includes an inertia member, a first spring, and a second spring, and is activated upon the rotation of a lay shaft of an operating mechanism of the circuit breaker. The first spring extends between the inertia member and a housing of the circuit breaker and biases the inertia member from an initial position toward a terminal position. The second spring extends between the lay shaft and the inertia member and biases the inertia member toward the initial position when the circuit breaker is in an OFF condition. In switching the circuit breaker from the OFF condition to an ON condition, the lay shaft pivots from a first position to a second position, and in so doing passes through an intermediate position. As the lay shaft moves between the first position and the intermediate position, the second spring overcomes the bias of the first spring and retains the inertia member in the initial position. After the lay shaft passes through the intermediate position on its way to the second position, the first spring overcomes any bias of the second spring and begins to rotate the inertia member toward the terminal position, thereby providing a time delay to a switch operated by the inertia member.

Accordingly, an aspect of the present invention is to provide an improved circuit breaker having a delay mechanism that delays for a certain period of time an input to a trip unit indicating a change in state of the circuit breaker.

Another aspect of the present invention is to provide an improved circuit breaker having a delay mechanism that employs an inertia member.

Another aspect of the present invention is to provide an improved circuit breaker having a delay mechanism that employs two springs, one of which extends between an inertia member and a substantially stationary structure such as a housing of the circuit breaker, the other of which extends between the inertial member and a movable member such as a lay shaft.

Another aspect of the present invention is to provide an improved circuit breaker having an inertial delay mechanism that avoids the use of a relatively massive inertial member by providing a relatively small inertial member and a pair of springs that interact with different structures of the circuit breaker.

Another aspect of the present invention is to provide an improved circuit breaker that includes a self-powered trip unit that receives a time delayed signal indicating a change in state of the circuit breaker from an OFF condition to an ON condition.

Accordingly, an aspect of the present invention is to provide an improved circuit breaker that is movable between an OFF condition and an ON condition, in which the general nature of the circuit breaker can be stated as including a housing, a set of separable contacts, an operating mechanism, a trip unit, a switch, and a delay mechanism. The separable contacts are disposed on the housing. The operating mechanism is disposed on the housing and is operable to move the contacts between a disconnected position and a connected position when activated. The operating mechanism includes a movable structure that is movably disposed on the housing and is movable between a first position corresponding with the OFF condition of the circuit breaker and a second position corresponding with the ON condition of the circuit breaker. The trip unit is responsive to current through the separable contacts for activating the operating mechanism. The switch provides an input to the trip unit, and the switch is switchable between a first condition corresponding with the OFF condition and a second condition that corresponds with the ON condition. The delay mechanism is for delaying movement of the switch from the first condition to the second condition for a given period of time after a circuit breaker has moved from the OFF condition to the ON condition. The delay mechanism includes an inertia member, a first spring, and a second spring. The inertia member is movable between an initial position corresponding with the OFF condition of the circuit breaker and a terminal position corresponding with the ON condition of the circuit breaker, the inertia member in the initial position maintaining the switch in the first condition, the inertia member in the terminal position permitting movement of the switch to the second condition. The first spring extends between the inertia member and the housing and biases the inertia member toward the terminal position. The second spring extends between the movable structure and the inertia member when the movable structure is in the first position, with the second spring biasing the inertia member toward the initial position and overcoming the bias of the first spring to retain the inertia member in the initial position when the movable structure is in the first position. The bias of the first and second springs is equal and retains the inertia member in a state of equipoise at the initial position when the movable structure is in an intermediate position between the first and second positions. The bias of the first spring overcomes any bias of the second spring and biases the inertia member toward the terminal position when the movable structure is in substantially any of the second position and a location disposed between the intermediate and second positions.

BRIEF DESCRIPTION OF THE DRAWINGS

A further understanding of the invention can be gained from the following Description of the Preferred Embodiment when read in conjunction with the accompanying drawings in which.

Similar numerals refer to similar parts throughout the specification.

DESCRIPTION OF THE PREFERRED EMBODIMENT

Figure 1:
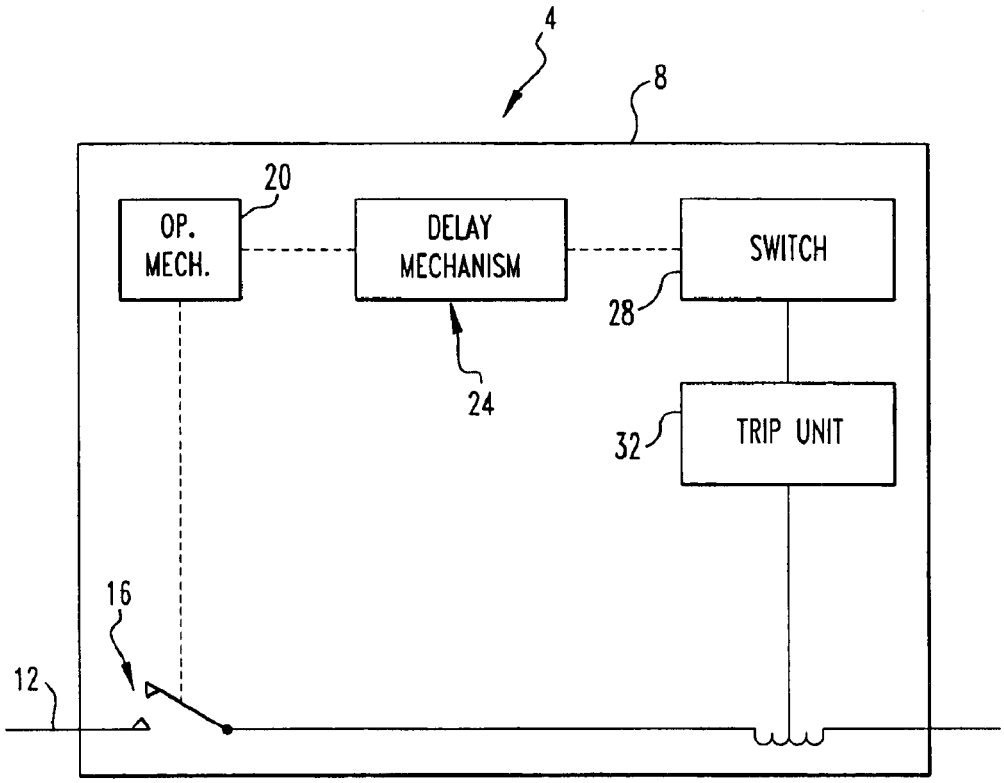
FIG. 1 is a schematic view of an improved circuit breaker in accordance with the present invention.

An improved circuit breaker 4 in accordance with the present invention is indicated schematically FIG. 1. The circuit breaker 4 includes a housing 8 that carries a conductor 12 which passes current through the circuit breaker 4, a set of separable contacts 16 interposed within the conductor 12 to selectively interrupt the flow of current therethrough, and an operating mechanism 20 that operates the contacts 16. In accordance with the present invention, the circuit breaker 4 advantageously additionally includes a delay mechanism 24 that inertially delays the actuation of a switch 28 in order to provide a time delayed input to a trip unit 32 that the circuit breaker 4 has been switched between an OFF condition, such as is depicted generally in FIGS. 2 and 4 and an ON condition depicted generally in FIGS. 1 and 8.

The trip unit 32 includes self-powered electronics, meaning that trip unit 32 does not possess an auxiliary or external source of power for the electronics thereof apart from the current that flows through the conductor 12 when the circuit breaker 4 is in the ON condition. It is understood, however, that the teachings of the present invention can be employed in a circuit breaker even if the trip unit additionally includes an auxiliary power source. The delay mechanism 24 advantageously permits the trip unit 32 to become fully operational after switching the circuit breaker 4 to the ON condition prior to a signal indicating a change in state of the circuit breaker 4 being sent from the switch 28 to the trip unit 32.

Figure 2:
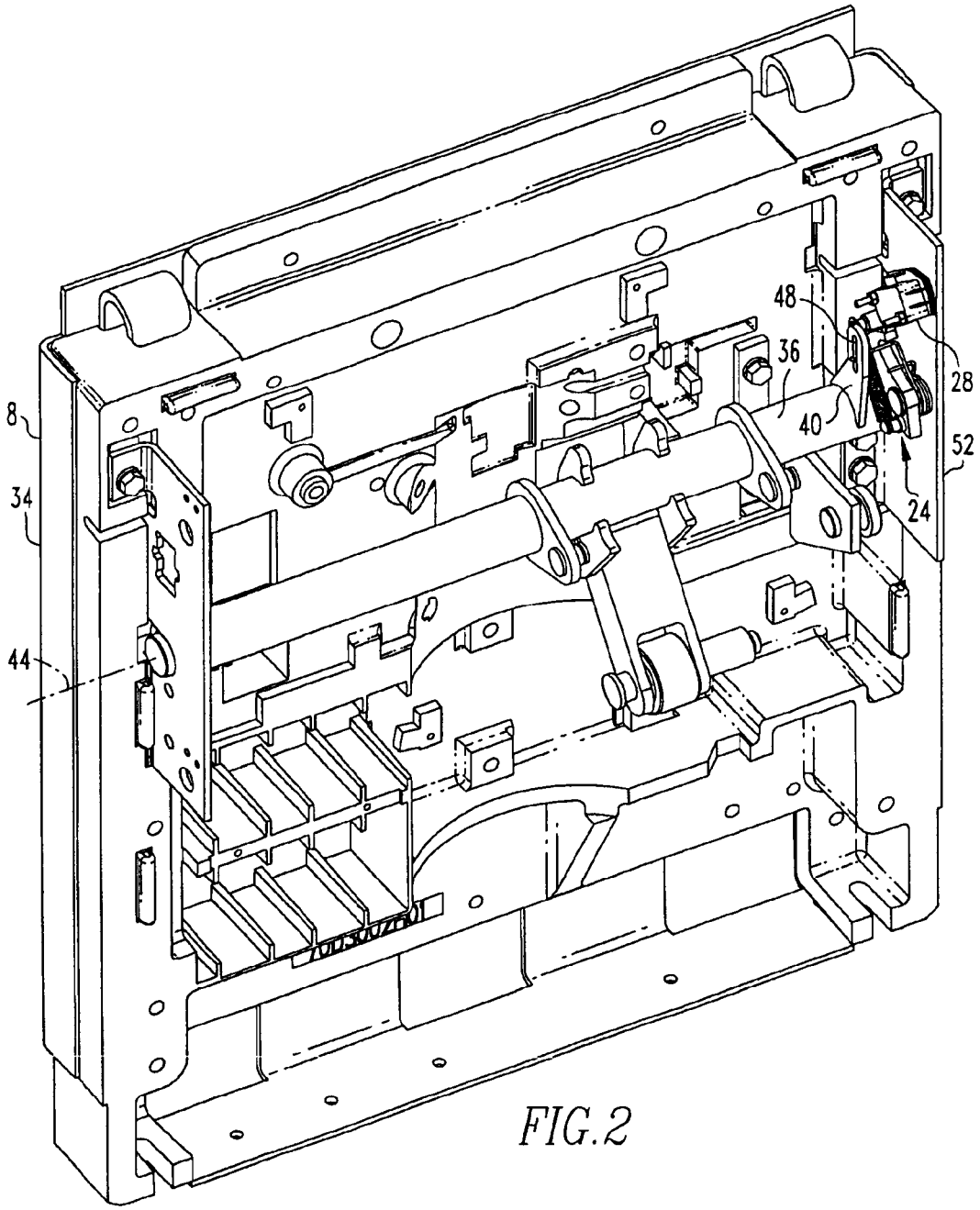
FIG. 2 is an isometric view of a portion of the circuit breaker including a delay mechanism.

FIG. 2 generally depicts a panel 34 of the housing 8 and additionally depicts a lay shaft 36 of the operating mechanism 20 disposed thereon. The operating mechanism 20 additionally includes a movable member which, in the exemplary depicted embodiment, is in the form of a crank 40 affixed to the lay shaft 36. The crank 40 is pivotably movable by pivoting of the lay shaft 36 about a shaft axis 44 when the circuit breaker is switched between the OFF and ON conditions. The crank 40 includes an elongated slot 48 formed therein that is cooperable with a part of the delay mechanism 24, as will be described below. As can be understood from FIGS. 1 and 2, the conductor 12, the separable contacts 16, the operating mechanism 20, the delay mechanism 24, the switch 28, and the trip unit 32 are disposed on the housing 8.

Figure 3:
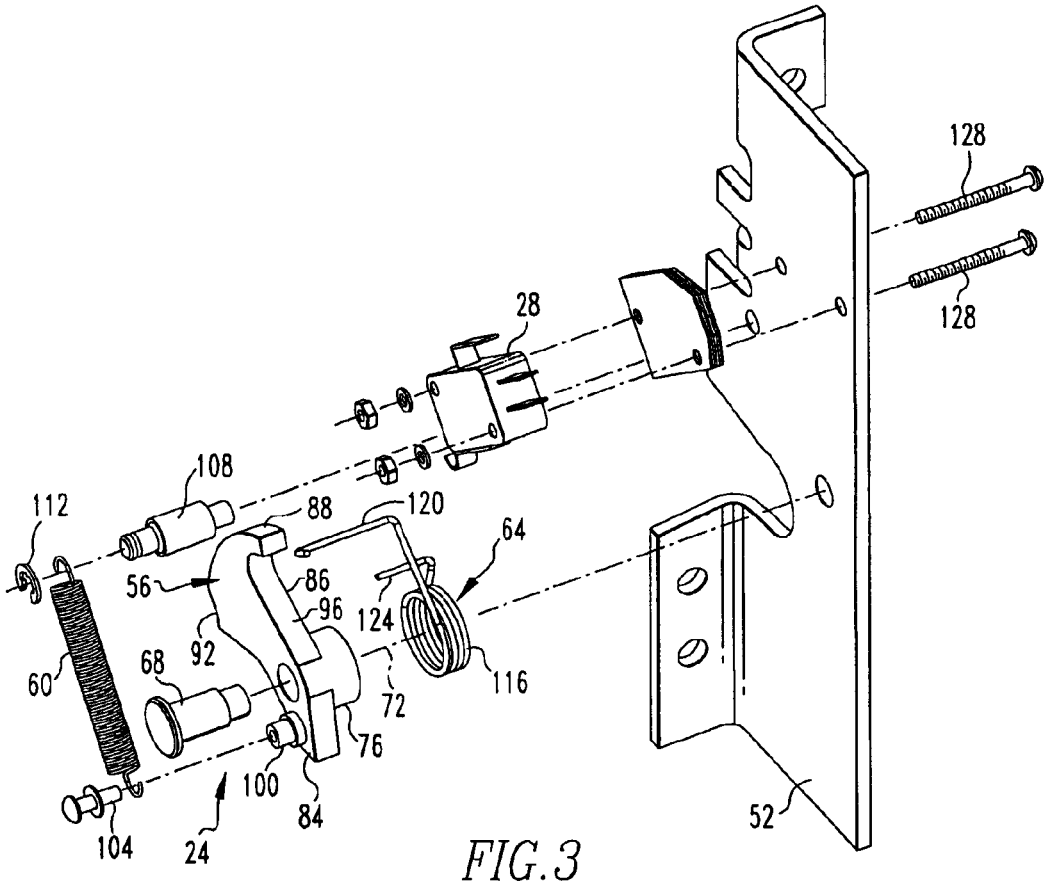
FIG. 3 is an exploded isometric view of the delay mechanism.

As can be understood from FIGS. 2 and 3, the housing 8 additionally includes a mounting plate 52 mounted to the panel 34. The delay mechanism 24 is generally mounted on the mounting plate 52.

As can be best seen from FIG. 3, the delay mechanism 24 includes an inertial member 56, a first spring 60, a second spring 64, and a pivot 68. The pivot 68 is affixed to the mounting plate 52. The inertia member 56 is pivotably mounted on the; pivot 68 and is pivotable about a pivot axis 72 provided by the pivot 68. As can be understood from FIG. 2, the pivot axis 72 and the shaft axis 44 are parallel with one another and spaced apart.

As can further be seen in FIG. 3, the inertia member 56 includes a central member 76, an extension portion 86 extending from the central member 76, and a foot 84 likewise extending from the central member 76 but in a different direction. In the exemplary depicted embodiment, the inertia member 56 is a monolithically formed single piece member that may be formed of a material such as injection-molded plastic, although other configurations and materials are possible.

Figure 4:
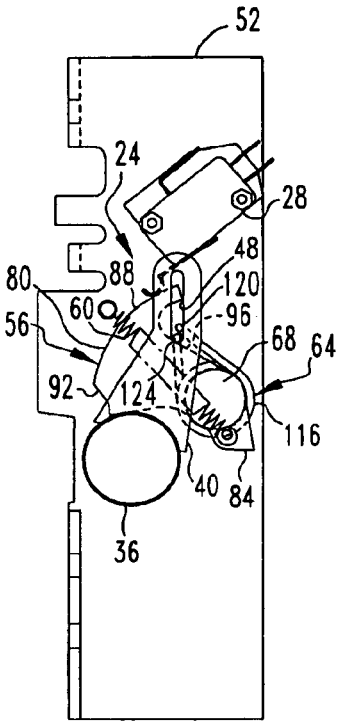
FIG. 4 is a view of the delay mechanism when the circuit breaker is in the OFF condition depicted generally in FIGS. 1 and 2.
Figure 7:
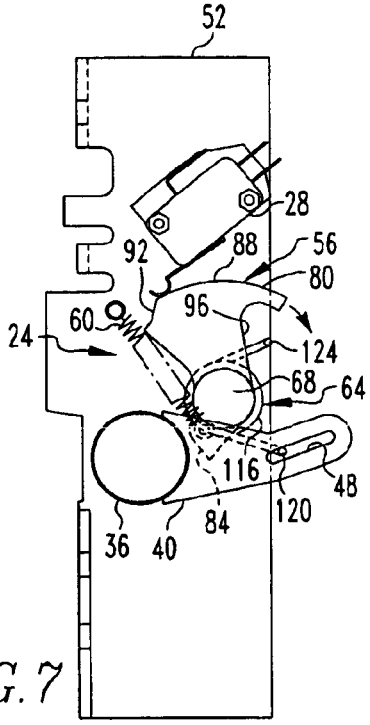
FIG. 7 is a view of the delay mechanism with the lay shaft being in the second position while the inertia member is between the initial and terminal positions.
Figure 8:
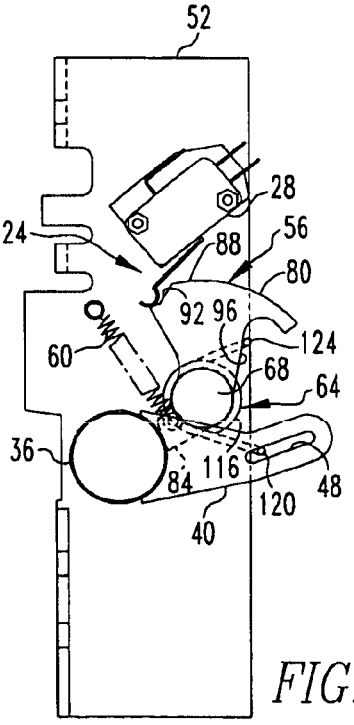
FIG. 8 is a view of the delay mechanism when the lay shaft is in the second position and the inertia member is in the terminal position.

The inertia member 56 is pivotable on the pivot 68 between an initial position, i.e., FIG. 4, that corresponds with the OFF condition of the circuit breaker 4, and a terminal position, i.e., FIG. 8, that corresponds with the ON condition of the circuit breaker 4. The extension portion 80 of the inertia member 56 includes an arcuate lateral surface 88 that terminates at an indentation 92. The lateral surface 88 is engaged with the switch 28 to retain the switch in a first condition, i.e., FIGS. 4–7, until the inertia member 56 is in its terminal position, at which time the lateral surface 88 is out of contact with the switch 28, thereby permitting the switch 28 to move from the first condition to the second condition. The lateral surface 88 is substantially at a fixed radius from the pivot 68.

Movement of the switch 28 from the first condition to the second condition provides a signal to the trip unit 32 indicating a change in state of the circuit breaker 4. The pivoting movement of the inertia member 56 from the initial position, i.e., FIGS. 4 and 5, to the terminal position, i.e., FIG. 8, provides a time delay in accordance with the present invention, as will be described in greater detail below. The extension portion 80 additionally includes a bearing surface 96 that is cooperable with the second spring 64 in a fashion described below.

The foot 84 includes a boss 100 extending therefrom that is cooperable with a pin 104 to connect with an end of the first spring 60. An opposite end of the first spring 60 is connected with a post 108 which carries a clip 112. The post 108 is affixed to the mounting plate 52. The first spring 60 thus can generally be said to extend between the inertia member 56 and the housing 8. The first spring 60 biases the inertial member 56 from the initial position, i.e., FIGS. 4 and 5, toward the terminal position, i.e., FIG. 8. In the exemplary depicted embodiment, ihe first spring 60 is a tension coil spring.

The second spring 64 is depicted in the exemplary embodiment as being a torsion spring having a body 116, a first leg 120, and a second leg 124. The body 116 extends about the central member 76 of the inertia member 56, and thus likewise extends about the pivot 68 and the pivot axis 72. The first leg 120 is slidably received in the slot 48 of the crank 40. The second leg 124 is receivable against the bearing surface 96 of the extension portion 80. As can be understood from FIG. 3, the switch 28 is affixed to the mounting plate 52 with a number of fasteners 128 which are depicted in the exemplary embodiment as being screws with nuts.

Figure 5:
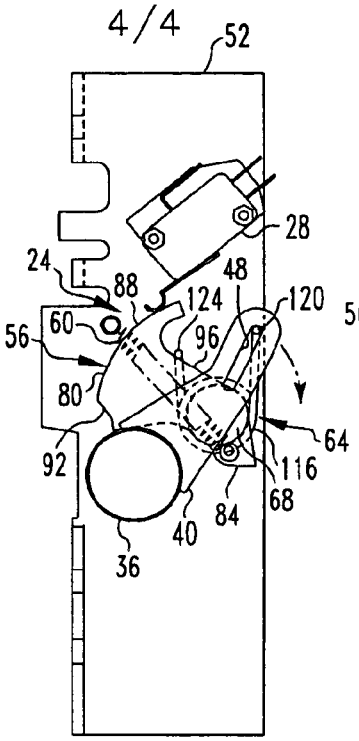
FIG. 5 is a view of the delay mechanism when a lay shaft of the circuit breaker is an intermediate position between the circuit breaker being in the OFF condition and an ON condition, and with an inertia member of the delay mechanism being in an initial position.
Figure 6:
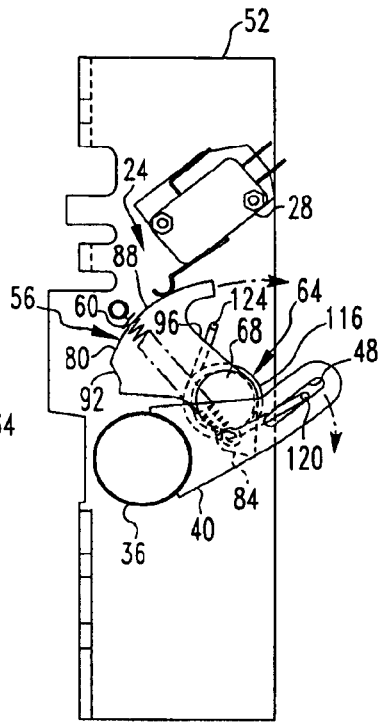
FIG. 6 is a view of the delay mechanism with the lay shaft being between the intermediate position and a second position corresponding with the circuit breaker being in the ON condition, and with the inertia member being between the initial position and a terminal position.

As can be understood from FIGS. 4–8, the lay shaft 36 and the crank 40 are movable between the first position which corresponds with the OFF condition of the circuit breaker 4 and is depicted in FIG. 4, and a second position that corresponds with the ON condition of the circuit breaker 4 and is depicted generally in FIGS. 7 and 8. When the lay shaft 36 is in the first position, the second leg 124 is received against the bearing surface 96, and the second spring 64 biases the inertia member 56 toward the initial position. In such a circumstance, i.e., when the circuit breaker is in the OFF condition, the bias of the second spring 64 overcomes the bias of the first spring 66 and retains the inertia member 56 in the initial position.

When the circuit breaker is switched from the OFF condition to the ON condition, the lay shaft 36 passes through an intermediate position, i.e., FIG. 5, in moving from the first position of FIG. 4 to the second position of FIGS. 7 and 8. Moreover, since the first leg 120 of the second spring 64 is received in the slot 48 and thus moves with the lay shaft 36, the bias of the second spring 64 decreases as the lay shaft 36 moves from the first position of FIG. 4 toward the intermediate position of FIG. 5. When the lay shaft 36 reaches the intermediate position of FIG. 5, the bias of the second spring 64 which biases the inertia member 56 toward the initial position has decreased to the point that it is equal to the bias of the first spring 60 that biases the inertia member 56 from the initial position toward the terminal position. In the intermediate position of FIG. 5, therefore, the inertia member 56 is retained in a state of equipoise at the initial position between the bias of the first spring 60 and the reduced bias of the second spring 64. It thus can be seen that while the lay shaft 36 has pivoted from the first position of FIG. 4 to the intermediate position of FIG. 5, the inertia member 56 has remained stationery at the initial position.

As can be understood from FIG. 6, with continued pivoting of the lay shaft 36 beyond the intermediate position and toward the second position, the bias of the second spring 64 is even further reduced, whereby the bias of the first spring 60 overcomes any bias of the second spring 64, which begins to move the inertia member 56 from the initial position toward the terminal position. In such a circumstance, the counteracting bias of the first spring 60 and any bias of the second spring 64 together result in a net bias by the first spring 64 that biases the inertia member 56 toward the terminal position. The lateral surface 88 of the inertia member 56 remains slidably engaged with the switch 28 until the inertia member 56 has pivoted generally to the terminal position, at which point the switch 28 is permitted to switch from the first condition to the second condition due to the proximity of the indentation 92.

An advantage of the delay mechanism 24 having both the first and the second springs 60 and 64 is that a relatively large time delay can be provided without providing the inertia member 56 with a substantial mass or polar moment of inertia. Rather, the time delay provided by the inertia member 56 comes about, at least in part, by the interaction of the first and second springs 60 and 64 acting on the relatively small inertia member 56. More specifically, by operatively extending the first spring 60 between the inertia member 56 and the housing 8 in the exemplary embodiment, and by operatively extending the second spring 64 between the inertia member 56 and the lay shaft 36, the inertia member 56 does not even begin to move from the initial position until after the lay shaft 36 has moved past the intermediate position of FIG. 5.

Once the inertia member 56 reaches the terminal position of FIG. 8, the foot 84 engages the lay shaft 36 to stop the pivoting motion of the inertia member 56. Relatively little stopping effect is required by the foot 84 to stop the inertia member 56 since the delay mechanism 24 is advantageously configured with both the first and second springs 60 and 64 and the relatively lightweight inertia member 56. In this regard, it is understood that the inertia member 56 moves with relatively low speeds and energies. Such reduced speeds and energies contribute to the longevity of the delay mechanism 24 and the reliability thereof.

The biasing forces of the first and second springs 60 and 64 are substantially at their maximum levels when the circuit breaker 4 is in the OFF condition of FIG. 4. Also, the body 116 of the second spring 64 pivots about the pivot axis 72 and thus about the pivot 68 between a first orientation, such as is depicted generally in FIG. 4, and a second orientation, such as is depicted generally in FIG. 8, when the circuit breaker 4 moves between the OFF and ON conditions.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker movable between an OFF condition and an ON condition, the circuit breaker comprising:

a housing;

a set of separable contacts disposed on the housing;

an operating mechanism that is disposed on the housing and is operable to move the contacts between a disconnected position and a connected position when activated, the operating mechanism including a movable structure that is movably disposed on the housing and is movable between a first position corresponding with the OFF condition of the circuit breaker and a second position corresponding with the ON condition of the circuit breaker;

a trip unit that is responsive to current through the separable contacts for activating the operating mechanism;

a switch for providing an input to the trip unit, the switch being switchable between a first condition corresponding with the OFF condition and a second condition that corresponds with the ON condition;

a delay mechanism for delaying movement of the switch from the first condition to the second condition for a given period of time after a circuit breaker has moved from the OFF condition to the ON condition;

the delay mechanism including an inertia member, a first spring, and a second spring;

the inertia member being movable between an initial position corresponding with the OFF condition of the circuit breaker and a terminal position corresponding with the ON condition of the circuit breaker, the inertia member in the initial position maintaining the switch in the first condition, the inertia member in the terminal position permitting movement of the switch to the second condition;

the first spring extending between the inertia member and the housing and biasing the inertia member toward the terminal position;

the second spring extending between the movable structure and the inertia member when the movable structure is in the first position, the second spring biasing the inertia member toward the initial position and overcoming the bias of the first spring to retain the inertia member in the initial position when the movable structure is in the first position;

the bias of the first and second springs being equal and retaining the inertia member in a state of equipoise at the initial position when the movable structure is in an intermediate position between the first and second positions; and the bias of the first spring overcoming any bias of the second spring and biasing the inertia member toward the terminal position when the movable structure is in substantially any of the second position and a location disposed between the intermediate and second positions.

2. The circuit breaker of claim 1 wherein the second spring extends between the movable structure and the inertia member and overcomes the bias of the first spring to retain the inertia member in the initial position when the movable structure is in any of the first position and a location disposed between the intermediate and first positions.

3. The circuit breaker of claim 1 wherein the inertia member is pivotably movable about a pivot between the initial and terminal positions.

4. The circuit breaker of claim 3 wherein the movable member is a crank affixed to a shaft that pivots the crank about a shaft axis between the first and second positions.

5. The circuit breaker of claim 4 wherein the second spring is a torsion spring having a body, a first leg, and a second leg, the body extending about the pivot, the first leg being engageable with the crank, the second leg being engageable with the inertia member.

6. The circuit breaker of claim 5 wherein the pivot provides a pivot axis for the inertia member, the pivot axis being parallel with and spaced from the shaft axis.

7. The circuit breaker of claim 6 wherein the crank includes a slot formed therein, the first leg being slidably disposed in the slot.

8. The circuit breaker of claim 5 wherein the body of the second spring pivots about the pivot between a first orientation and a second orientation when the circuit breaker moves between the OFF and ON conditions.

9. The circuit breaker of claim 4 wherein the inertia member includes a foot that is engaged with the shaft when the inertia member is in the terminal position.

10. The circuit breaker of claim 1 wherein the inertia member includes a lateral surface that is slidably engageable with the switch to retain the switch in the first condition when the inertia member is in the initial position.

11. The circuit breaker of claim 10 wherein the lateral surface is disengaged from the switch to permit the switch to move to the second condition when the inertia member is in the terminal position.

12. The circuit breaker of claim 10 wherein the inertia member is pivotably movable about a pivot between the initial and terminal positions; and the lateral surface being of a substantially fixed radius from the pivot.

13. The circuit breaker of claim 1 wherein the biasing forces of the first and second springs are substantially at a maximum when the circuit breaker is in the OFF condition.

* * * * *